United States Patent [19]

Petkov et al.

[11] Patent Number: 4,480,453

[45] Date of Patent: Nov. 6, 1984

[54] APPARATUS FOR BLAST HYDROPLASTIC FINISHING OF TUBULAR BILLETS

[75] Inventors: Georgi K. Petkov, Gabrovo, Bulgaria; Peter I. Davidkov, deceased, late of Gabrovo, Bulgaria, by Stefka H. Davidkova, executrix

[73] Assignee: N P S P po Hydroplastichna Obrabotka na Metalite, Gabrovo, Bulgaria

[21] Appl. No.: 559,975

[22] Filed: Dec. 9, 1983

[51] Int. Cl.[3] ..... B21D 22/10

[52] U.S. Cl. ..... 72/56; 29/421 E; 72/62

[58] Field of Search ..... 72/56, 60, 61, 62, 421 E

[56] References Cited

U.S. PATENT DOCUMENTS 3,559,271 2/1971 Nilsson ..... 72/56

4,049,367 9/1977 Tominoga ..... 72/56

FOREIGN PATENT DOCUMENTS 889476 12/1981 U.S.S.R. ..... 72/56

*Primary Examiner*—Leon Gilden

[57] ABSTRACT

Apparatus for the blast hydroplastic finishing of tubular billets, comprising a housing to which there are attached front and back stops, while the back stop has a blast chamber and a work tool disposed in it. In the back stop, after the blast chamber, there are a guiding chamber and a compensating chamber, the three being interconnected. The work tool in its initial position is disposed against a rest in the guiding chamber. The tool has a center blind hole and radial channels connected thereto, and in the front end of the work tool there is a gasket. In the front stop there is mounted a fixed ram and there is positioned a traveling cylindrical piston with a center blind hole wherein the tubular billet is disposed. One end of this cylindrical piston slips over the fixed ram so that a recoil chamber is formed, the recoil chamber being connected to the compensating chamber through longitudinal grooves in the traveling cylindrical piston.

5 Claims, 7 Drawing Figures

APPARATUS FOR BLAST HYDROPLASTIC FINISHING OF TUBULAR BILLETS

This invention relates to an apparatus for the blast hydroplastic finishing of tubular billets.

An apparatus is known to those familiar with the art for the profiling of outer surfaces of cylindrical bodies through hydroplastic deformation (Author's Certificate of Peoples Republic of Bulgaria No. 23783-IPC$^2$ B21B29/10) comprising a housing and a die coupled to a press. To the housing there is attached a vertical power cylinder with a piston. The die is of profiled inner surface and the billet to be machined or formed is disposed therein, both the die and the billet resting on a dynamic support. To the piston of the vertical power cylinder there is secured a smooth broach with a blind center hole and radial passages connected thereto. The piston of the vertical power cylinder has a central groove connected to the high pressure space of the vertical power cylinder and to the blind center hole of the smooth broach. There are grooves in the housing through which the high pressure space in the vertical power cylinder is connected to the oil feed system of the apparatus.

For the processing of cylindrical billets with the press ram the vertical power cylinder and the tool (the smooth broach) move along the axis of the cylindrical billet being processed. From this movement a counterforce results, high pressure being created in the space of the vertical power cylinder. Under the action of this pressure, forced lubrication of the surface being processed and of the tool is effected.

The disadvantages of this apparatus are as follows:

As the apparatus is attached to a press, the length of the billets to be processed is restricted by the clearance between the tables and the strokes of the press. This renders the unit inappropriate for larger cylindrical billets.

The die wherein the billet is disposed is fixed, and this limits metal flow in the direction opposite to the stress of deformation. As a result, the apparatus cannot be used for the processing of billets of larger lengths and at higher deformation rates.

Superhigh pressures cannot be created in the vertical power cylinder, equal or similar to the resistivity contact pressures between the work tool and the billet being processed. This condition limits the creation of a sufficiently thick lubricating layer to minimize fluid friction.

At the start of the cylindrical billet processing, in the entire tool and also during the whole period of processing, no lubrication fluid under pressure is fed to the first deformation element of the tool, and the tool operates under the conditions of dry or threshold lubrication.

An apparatus is known to those familiar with the art for blast processing of the inner surfaces of tubes (Author's Certificate of the USSR No. 412724-IC$^2$ B21D26/08) comprising a housing to which front and back stops are attached. To the back stop there is attached an acoustic damper, a blast chamber, and an intermediate stop. The back stop accomodates a piston with a blind axial hole in which the work tool is positioned. The front and back stops are interconnected through a casing. The billet to be processed is disposed at the front stop, and behind it there is disposed a trapping hopper.

Explosive is loaded in the blast chamber and, after it has been ignited, under the action of the blast the work tool flies off in a free flight and while passing through the billet processes its inner surface.

The disadvantages of the above-known apparatus are as follows:

From the free flight of the tool, surface pulse processing of the inner surface of the billet under the conditions of dry friction is effected. As a result of this friction and the superhigh speeds for longer billets, high temperatures develop, and thus intensive wear or melting of the billet and tool surfaces is provoked. Hence, longer billets cannot be used and processed in such known apparatus because of the possibility for tool seizure, and the resultant blowing up of the unit.

As the front stop, which serves as an encompassing rim, is fixed, there is no possibility for presetting a higher deformation rate and plastic flow of the metal, because of the fact that the flowing metal entraps the front stop and detaches it from the apparatus.

The present invention has among its objects the provision of an apparatus for blast hydroplastic finishing of tubular billets of such construction as to insure blast processing and hydroplastic deformation of the billets to be processed under conditions of superhigh fluid pressure.

This object is accomplished with the apparatus of the invention, which comprises a housing to which there are attached front and back stops. A trapping hopper is mounted behind the front stop. In the back stop there is a blast chamber, a guiding chamber, and a compensating chamber, the three chambers being interconnected. In the guiding chamber there is a stop against which the work tool is positioned at the start of the operation, the work tool having a central blind hole and radial passages connected thereto. In the front end of the work tool there is a gasket. In the front stop there is fixedly positioned a ram, and there is positioned a traveling cylindrical piston with a central hole. The tubular billet to be processed is set in the central hole of the traveling cylindrical piston. One of the traveling cylindrical piston slips within the fixed ram, so that a recoil chamber, connected with the compensating chamber through longitudinal grooves in the traveling cylindrical piston, is formed.

When a longer tubular billet is processed, the center blind hole of the work tool is of step design with a multiplicator positioned in its rear end. The multiplicator comprises a free traveling piston and a chamber, formed in front of the free traveling piston, in the center blind hole.

The outer surface of the work tool is profiled when a tubular billet of a profiled inner surface is to be obtained. When there is a requirement for a tubular billet to be profiled, then the inner surface of the traveling cylindrical piston is profiled. When both surfaces of the tubular billet are to be profiled, then use is made simultaneously of a work tool with an outer profiled surface and a traveling cylindrical piston of a profiled inner surface.

The advantages of the apparatus according to the invention are as follows:

The design widens the application range of blast processing to the field of hydroplastic smooth and profiled processing of long tubular billets, and also to the processing of tubular billets from hard-to-deform metals by such forming.

The deformation process is carried out under the conditions of universal uneven compression and the flow of nondeformed metal, in a direction opposite to the direction of motion of the work tool, and is assisted by the back recoil thrust resulting from fluid pressure on the larger front end of the traveling cylindrical piston.

The tubular billet obtained features new mechanical and physical properties compared to the initial billet, and this results from the superhigh pressure and rates under which the deformation process is carried out.

All these advantages result in an increase in the productivity rate and in tubular billets of high surface quality.

Reference will now be made by way of example to the accompanying drawings, wherein.

Figure 1:
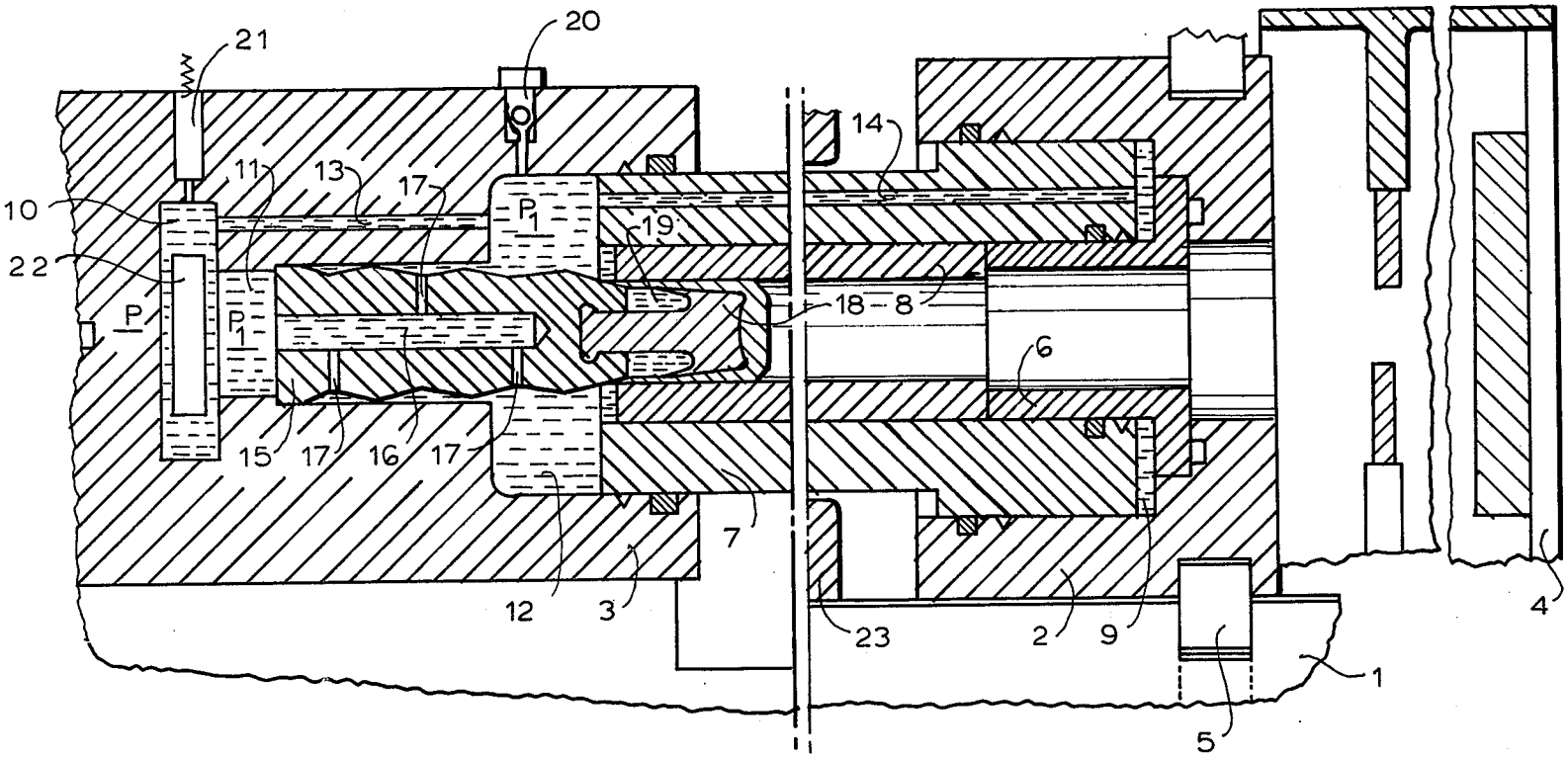
FIG. 1 is a view in longitudinal axial section of a first embodiment of the apparatus of the invention with the parts thereof in the position which they occupy before the explosive material employed to power the work tool is fired.
Figure 2:
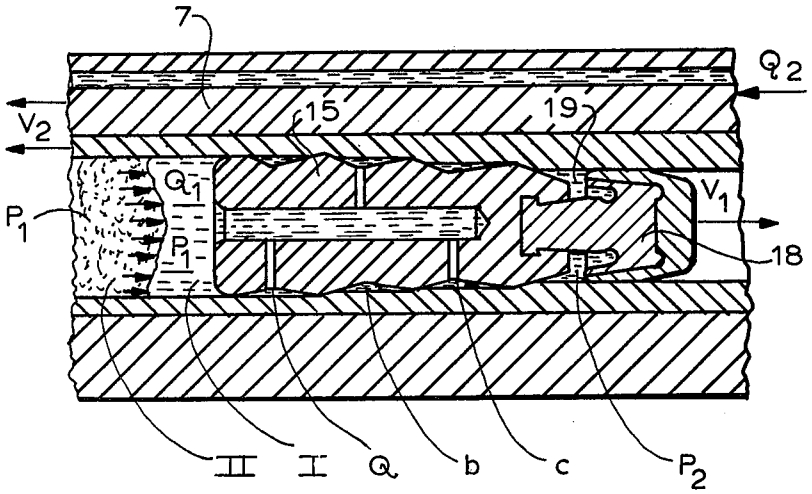
FIG. 2 is a parital longitudinal section of the apparatus of FIG. 1, with the work tool and the traveling cylindrical piston in working position.

The first embodiment of apparatus in accordance with the invention, shown in FIGS. 1 and 2, comprises a housing 1 to which a front stop 2 and a back stop 3 are attached. Behind said front stop 2 there is mounted a trapping hopper 4. Front stop 2 is attached to said housing 1 by a detachable joint 5 (for example wedges). In front stop 2 there is mounted a fixed ram 6; a traveling cylindrical piston 7 with a center hole in which the tubular billet 8 to be processed is mounted, is reciprocable in the front stop 2. The rear end of said traveling cylindrical piston 7 forms a recoil chamber 9 with the fixed ram 6.

In the back stop 3 there is successively formed a blast chamber 10, a guiding chamber 11, and a compensating chamber 12. Said blast chamber 10 and compensating chamber 12 are connected through longitudinally extending grooves 13 in back stop 3. Said recoil chamber 9 is connected to compensating chamber 12 through longitudinal grooves 14 in traveling cylindrical piston 7.

In guiding chamber 11, there is shown a work tool 15 positioned in a terminal position at the left against a rest or stop in the form of a shoulder in chamber 11. The work tool 15 has a center blind hole 16 and radial passages 17 which are connected to said center blind hole 16. In the front end of the work tool 15 there is a gasket 18, positioned in tubular billet 8, so that a chamber 19 is formed. Compensating chamber 12 is equipped with a vent valve 20 and blast chamber 10 is equipped with the feed valve 21. Explosive material 22 is loaded into blast chamber 10. Between the front stop 2 and the back stop 3 there is a guide 23 for supporting the traveling cylindrical piston 7.

The apparatus of FIGS. 1 and 2 operates as follows: Traveling cylinder piston 7 together with front stop 2 and guide 23 move to the right until said traveling cylindrical piston 7 protrudes out of compensating chamber 12. At this point, blast chamber 10 is loaded with explosive material 22 and in guiding chamber 11 work tool 15 is positioned at the left against its rest or stop. Then front stop 2 with the traveling cylindrical piston 7 and guide 23 go back to the starting position so that said traveling cylindrical piston 7 penetrates into the compensating chamber 12 up to a fixed closed position. In this position, work tool 15 does not touch the face of the tubular billet 8 being processed, and gasket 18 has entered the central hole in the tubular billet 8 being processed. With a pump unit (not shown) a coolant is fed through feed valve 21 to fill recoil chamber 9, compensating chamber 12, guiding chamber 11, blast chamber 10, and chamber 19. The air is exhausted by vent valve 20, then said valve is locked and the pump unit stops. There is additional pressing of the system formed by front stop 2, traveling cylindrical piston 7, and tubular billet 8 to be processed, by an auxiliary screw mechanism or the like until the inner edge of the tubular billet 8 squeezes against the work tool 15. Thus the individual chamber 19 is formed.

Next, explosive material 22 is fired or blown up, and under the action of the burst in recoil chamber 9, compensating chamber 12, blast chamber 10, and guiding chamber 11 an almost uniform pressure $p_1$ is generated, which is relieved through the weakest chain of the system, in this case the work tool 15. The latter, at the rate of the burst and with $O_1$ force, passes through the hole of tubular billet 8, while processing it. In the moment when work tool 15 passes through the processed hole in tubular billet 8 (FIG. 2) at $V_1$ rate, under the action of the burst a superhigh pressure $p_1$ acts in the coolant behind work tool 15, filling the central blind hole 16, radial grooves 17, and closed spaces a, b, and c. This pressure packs the lubricant and a fluid layer of a sufficient thickness is formed for producing hydrodynamic friction in the contact zone between deforming serrations of work tool 15 and the processed surface of tubular billet 8.

In chamber 19 pressure $P_2 < P_1$ is generated, resulting from the pressure exerted by gasket 18 on the coolant behind said gasket 18. This $P_2$ pressure, in parallel with the entrapping pressure of the coolant at a $V_1$ rate, provides the fluid layer for producing hydrodynamic friction along the front surface of work tool 15. The deformation of the tubular billet processed proceeds under the conditions of universal uneven compression, and the metal flows in the direction of lowest resistance $V_2$, opposite the direction of movement of the work tool 15. There is counteraction to this metal flow by the friction forces created between the outer surface of the tubular billet 8 and the inner surface of travelling cylindrical piston 7. As it is only a force $O_2$ that is acting on travelling cylindrical piston 7, said piston moves in the direction of metal flow and this has an entrapping effect on the flow while simultaneously partially damping the impact of the blast, and forces the coolant out of the compensating chamber 12 towards the work tool 15 after having passed from the deformation area, work tool 15, at a rate lower than its initial rate, falls into the trapping hopper 4.

Figure 3:
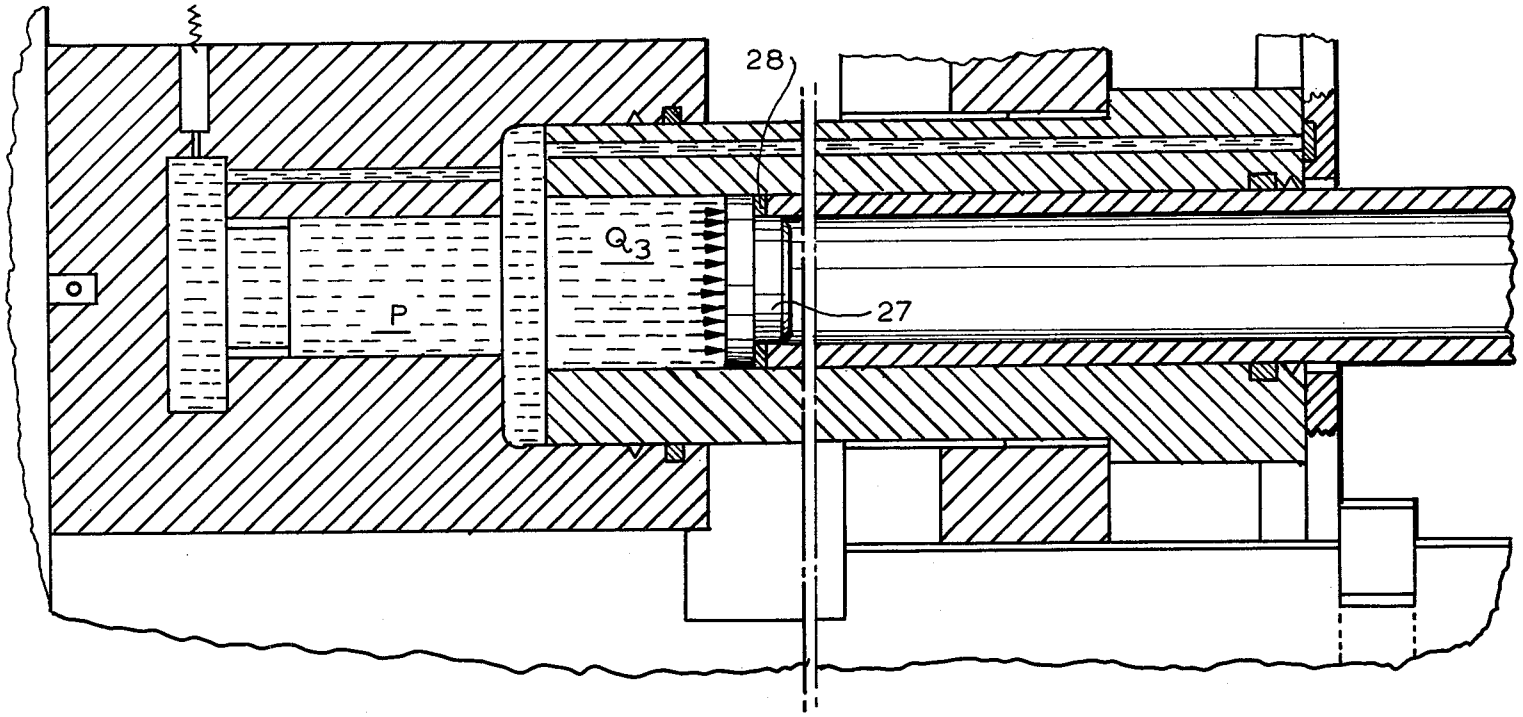
FIG. 3 is a view in partial longitudinal section of the apparatus showing billet knock-out after processing.
Figure 4:
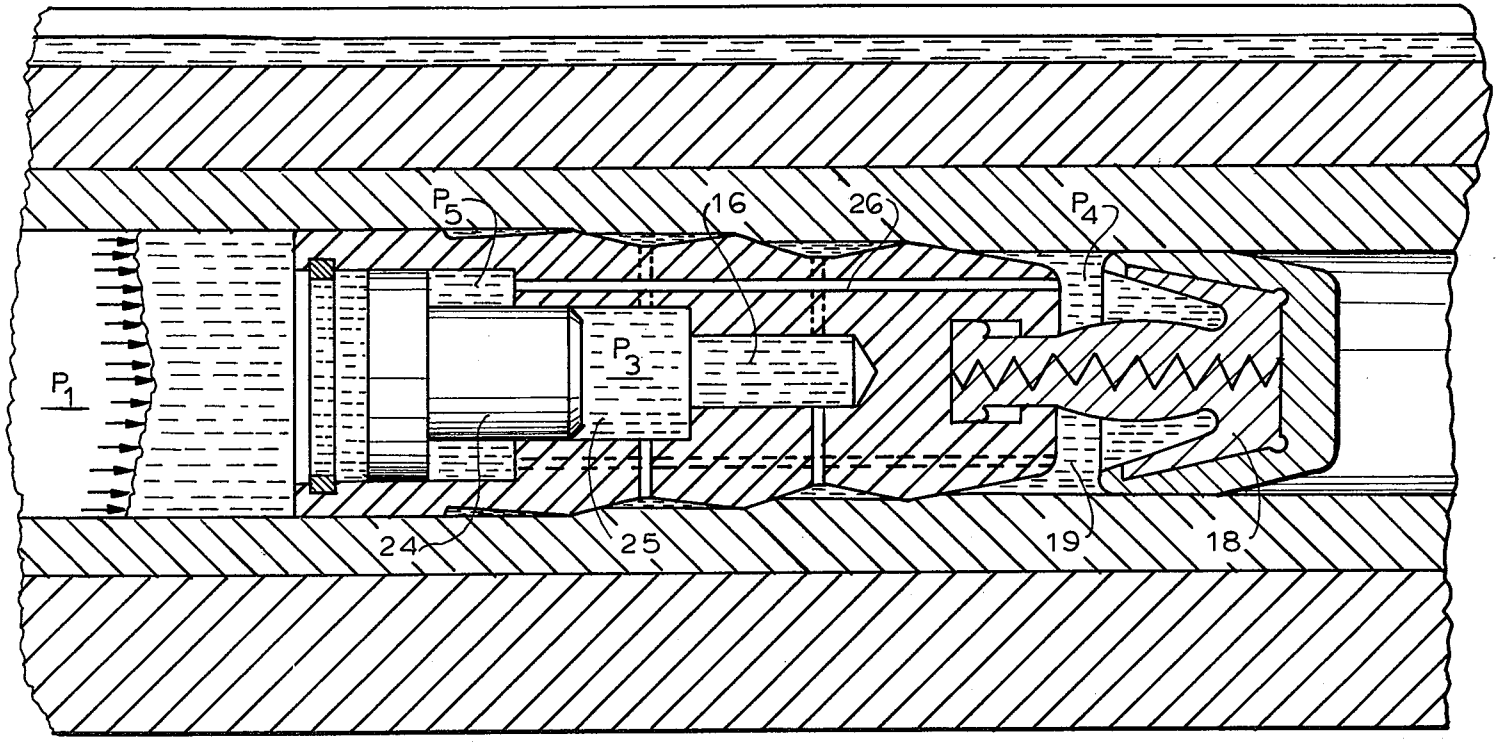
FIG. 4 is a view in longitudinal axial section of a second embodiment of the apparatus of the invention, such apparatus having a multiplicator incorporated into the work tool.

Tubular billet 8 is knocked out (FIG. 3) by feeding pressure p, acting with a force on a cap 27 which is set on the end of tubular billet 8 and to gasketed to the travelling piston 7 by seal 28. A microblast could equally serve the purpose of billet knock-out.

Figure 6:
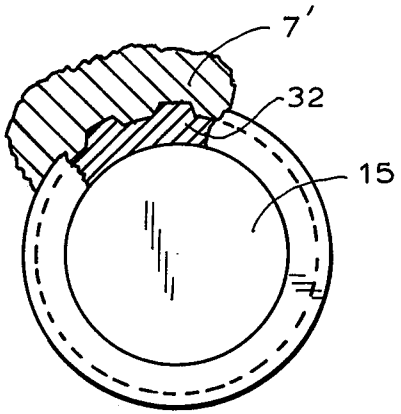
FIG. 6 is a view in cross-section of a tubular billet processed to have an outer profiled surfaces.

When longer tubular billets are to be processed, the embodiment of the apparatus of the invention shown in FIG. 6 can be used. In such embodiment the center blind hole 16 of the work tool 15 is of step design. In its back end there is positioned a multiplicator, consisting of a free traveling piston 24 and a chamber 25 formed in front of said free traveling piston 24, in center blind hole 16. In this embodiment of the apparatus there are provided longitudinal grooves 26 connecting the space through the wide section of the free traveling piston 24 and the chamber 19 formed behind the gasket 18.

Figure 5:
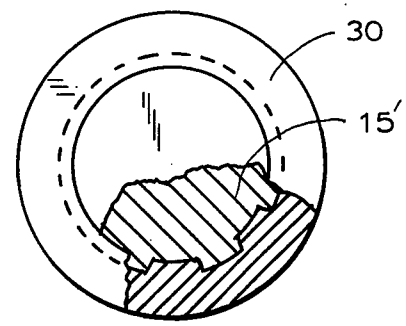
FIG. 5 is a view in cross-section of a tubular billet processed to have an inner profiled surface.
Figure 7:
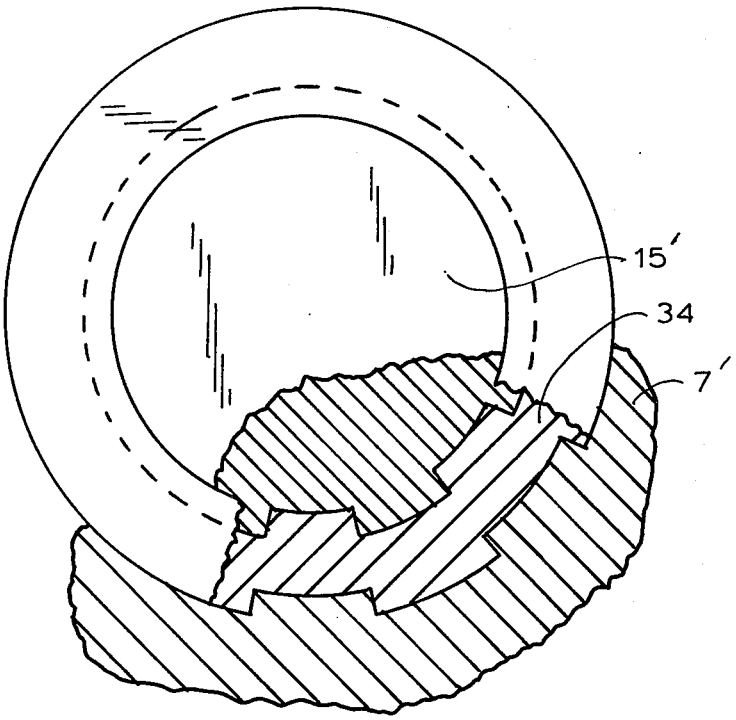
FIG. 7 is a view in cross-section of a tubular billet processed to have inner and outer profiled surfaces.

In FIG. 5 there is shown a billet 30 being formed with a profiled inner wall by a profiled work tool 15'. In FIG. 6 there is shown a billet 32 being formed by a work tool 15 cooperating with a profiled cylinder or die 7'. In FIG. 7 there is shown a billet 34 being formed with a profiled inner wall by a work tool 15' and with a profiled outer wall by a cylinder or die 7'.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An apparatus for the blast hydroplastic finishing of tubular billets, comprising a housing, a front stop and a back stop mounted on the housing, (and behind said front stop there is mounted a trapping hopper,) said back stop having a blast chamber and a work tool positioned in it, in the back stop and behind the blast chamber there are a guiding chamber and a compensating chamber, the three chambers being interconnected, a work tool positioned in the guiding chamber, said tool having a center blind hole and radial grooves connected thereto, in the front end of said work tool there being a gasket, in the front stop there being mounted a fixed ram and a traveling cylindrical piston with a center hole in which the tubular billet is disposed, said cylindrical billet at one end slipping on the fixed ram so that a recoil chamber is formed, the recoil chamber being connected to compensating chamber through longitudinal grooves in the traveling cylindrical piston.

2. An apparatus according to claim 1, wherein the center blind hole of the work tool is of step configuration and in its bottom there is positioned a multiplicator comprising a free traveling piston and a chamber formed in front of said free traveling piston in said center blind hole.

3. An apparatus according to claim 1, wherein the outer surface of the work tool is profiled.

4. An apparatus according to claim 1, wherein the center hole of the cylindrical piston has a profiled surface.

5. An apparatus according to claim 1, wherein the outer surface of the work tool and the surface of the center hole of the cylindrical piston are profiled.

* * * * *